US006096493A

United States Patent [19]

Shuttleworth et al.

[11] Patent Number: 6,096,493

[45] Date of Patent: Aug. 1, 2000

[54] MAGENTA AND YELLOW COUPLER COMBINATION IN SILVER HALIDE PHOTOGRAPHIC ELEMENT

[75] Inventors: Leslie Shuttleworth, Webster, N.Y.; Rakesh Jain, Cupertino, Calif.; John W. Harder, Rochester, N.Y.

[73] Assignee: Eastman Kodak Company, Rochester, N.Y.

[21] Appl. No.: 09/134,621

[22] Filed: Aug. 14, 1998

[51] Int. Cl.[7] ..... G03C 1/08; G03C 7/26; G03C 7/32

[52] U.S. Cl. ..... 430/549; 430/556; 430/557; 430/558; 430/551

[58] Field of Search ..... 430/558, 557, 430/556, 551, 549

[56] References Cited

U.S. PATENT DOCUMENTS

| | | | |
|---|---|---|---|
| 5,143,821 | 9/1992 | Crawley et al. | 430/558 |
| 5,776,669 | 7/1998 | Crawley et al. | 430/558 |
| 5,876,912 | 3/1999 | Crawley et al. | 430/558 |

*Primary Examiner*—Geraldine Letscher
*Attorney, Agent, or Firm*—Arthur E. Kluegel

[57] ABSTRACT

Disclosed is a photographic element comprising a light-sensitive silver halide emulsion layer having associated therewith a certain magenta dye forming coupler and a light-sensitive silver halide emulsion layer having associated therewith a certain yellow dye-forming coupler. The element exhibits improved dye fade and equal or better red color gamut than that obtained using comparisons.

11 Claims, No Drawings

MAGENTA AND YELLOW COUPLER COMBINATION IN SILVER HALIDE PHOTOGRAPHIC ELEMENT

FIELD OF THE INVENTION

The present invention relates to a silver halide photographic element having improved color reproduction and particularly to direct viewing color photographic recording materials containing particular classes of cyan and magenta couplers, the combination of which provides uniquely high color purities and a substantially larger dye gamut than known color photographic materials.

BACKGROUND OF THE INVENTION

A typical photographic element contains multiple layers of light sensitive photographic silver halide emulsions with one or more of these layers being spectrally sensitized to each of blue light, green light and red light. In the conventional subtractive color system, the blue, green and red light sensitive layers typically contain yellow, magenta and cyan dye forming couplers, respectively.

To form color photographic images, the color photographic material is exposed imagewise and processed in a color developer bath containing an aromatic primary amine color developing agent. Image dyes are formed by the coupling reaction of these couplers with the oxidized product of the color developing agent.

It has been an ongoing object of photographic researchers efforts for many years to develop and combine cyan, magenta and yellow image dyes of different chemical structures in order to improve the range of colors produced and hence increase the dye color gamut.

Direct viewing color print materials such as color papers, transparent back-lighted advertising materials, motion picture print films and color reversal slide films rely on the formation of color metamers within the photographic element to reproduce the color of an image. The color image is formed by generating a combination of cyan, magenta and yellow dyes in proportion to the amounts of exposure of red green and blue light respectively onto the element with the object being for the reproduced image to duplicate as nearly as possible the stimulation of the optic sensors of the eye resulting from the original image.

Thus, any color in the original scene is reproduced as a unique combination of the cyan, magenta and yellow image dyes in the viewed print material. The absolute relationship of the original color to the reproduced color is a combination of many factors. It is, however, limited by the dye gamut achievable by the multitude of combinations of cyan, magenta and yellow dyes used to generate the final image. Dye gamut is a measure of the variety of colors capable of being reproduced by the combination of dyes used to make the image.

Dye gamut is limited by many features of an imaging system. For example, dye gamut is limited by the minimum and maximum densities achievable by the photographic element, by the color purity of the individual dyes, etc. Color purity of a dye is a function of the secondary absorption of the dye, the shape of the absorption band of the dye, and its bandwidth. In addition to the individual dye characteristics, to achieve the highest color gamut, it is necessary to have cyan, magenta and yellow image dyes which have the preferred absorption maxima relative to one another: narrow bandwidth (to increase color purity) and absorption band shapes which function together to provide a maximum dye gamut.

In the measurement of color, or colorimetry, the colorimetric term chroma (C*) is a measure of the color saturation or color purity (sometimes referred to as 'brilliance'). Since C* changes as a function of its lightness (L*) it is necessary to specify L* when comparing C* measurements between different examples. In order to measure C*, it is first necessary to specify the illuminant under which the subject is to be measured or viewed. It is convenient to specify a color temperature rather than a specific light source such as daylight, tungsten or fluorescent. For daylight viewing, a color temperature of 5000° K. is representative of a typical daylight illuminant.

Chroma itself does not imply a given color or dye hue, but rather is a measure of the purity of a given color. As such, a value for C* is first obtained by measuring two other colorimetric terms, a* and b*. These metrics, when specified in combination, describe the color of an object, whether it be red, green, blue, etc. The measurement of a* and b* is well documented and now represents an international standard of color measurement. (The well known CIE system of color measurement was established by the International Commission on Illumination in 1931 and was further revised in 1971. For a more complete description of color measurement refer to "Principles of Color Technology, 2nd Edition by F. Billmeyer, Jr. and M. Saltzman, published by J. Wiley and Sons, 1981.)

Simply stated, a* is a measure of how green or magenta the color is (since they are color opposites) and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

Where X, Y and Z are the tristimulus values obtained from the combination of the visible reflectance spectrum of the object, the illuminant source (i.e. 5000°K.) and the standard observer function.

Once a* and b* are obtained, the value of C* may be obtained by the following equation:

$$C^*=(a^{*2}+b^{*2})^{1/2}$$

Thus in a photographic element, as dye formation increases as a function of increasing exposure, the density of the element increases. Since L* is a measurement of lightness or darkness it changes in concert with density. Since an L* of 100 is perfectly white, there is no color. Correspondingly, an L* of 0, is perfectly black and again, there is no color. Therefore color only exists if L* has a value greater than 0 and less than 100.

The value of L* is a function of the tristimulus value Y, thus $$L^*=116(Y/Y_n)^{1/3}-16$$

As exposure increases on a photographic element and dye density also increases in proportion due to color development, L* decreases. C*, however, increases with exposure to a maximum value. This maximum value is a function of many variables, but is generally bounded by the Dmin and Dmax of an element and the color purity of the dye being formed.

Magenta dyes absorb green light and typically have absorption maxima near the center of the green region, or about 550 nm. The most commonly used magenta couplers are those of the pyrazolone type. The image dyes derived from these couplers have several deficiencies, including an absorption spectra having too much unwanted absorption of blue and red light which limits the gamut of the colors obtainable using this type of coupler.

In recent years, magenta couplers have been developed based on pyrazolotriazole compounds, particularly the pyrazolo[1,5-c]triazole couplers. Compared to the pyrazolone based magenta couplers, thesa pyrazolotriazole couplers have been shown to have significantly lower unwanted absorption of blue and red light and to have a narrower dye adsorption bandwidth. These pyrazolotriazole couplers have also been shown to be excellent for light and dark image stability when compared to the pyrazolones. However the absorption curve for this type of coupler has been found to provide a less-than satisfactory gamut when used in combination with the types of yellow couplers currently in use. Further, the light fade of the magenta and yellow dyes formed are less than satisfactory.

Yellow dyes absorb blue light and typically have absorption maxima of about 450 nm. The precise location of the peak absorption depends upon several other factors including the shape of its absorption band, its bandwidth and the shapes and positions of the absorption bands of the cyan and magenta dyes with which it is associated. Couplers used to form the yellow dyes in direct viewing color print materials are usually based upon acylacetanilides and most typically, alkylacylacetanilides. Benzoylacetanilides are known to have absorption bands which absorb more green light than the alkylacetanilides and therefore are not preferred in direct viewing photographic systems.

Alkylacylacetanilide couplers in which the acetanilide ring is substituted with an alkoxy group in the ortho position of the anilide ring are known to produce yellow image dyes which have an absorption maxima at shorter wavelengths than those couplers which have a halogen (i.e. Cl) or other substituent. Shifting the absorption band to shorter wavelengths increases the color saturation and resultant color purity of the dye by reducing the unwanted absorption of green light. This is therefore a preferred embodiment. A preferred subclass of these yellow couplers is a cycloalkylacylacetanilide compound. The image dyes produced from these couplers have absorption maxima at shorter wavelengths with sharp cutting bands on their long wavelength sides also resulting in higher color purity.

Cyan dyes absorb red light and typically have an absorption maximum of about 650nm. Traditionally, the cyan dyes used in color papers have had nearly symmetrical absorption bands. Such dyes have rather large amounts of unwanted absorption in the green and blue regions of the spectrum. Much effort has gone into the design of the cyan dye forming coupler used in concert with the magenta and yellow couplers described above.

Couplers used to form cyan image dyes are generally derived from naphthols and phenols, as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479, 043; and in British patent 2,070,000.

It is a problem to be solved to provide a combination of magenta and yellow dye forming couplers that together exhibit improved dye fade resistance and an equal or increased red color gamut.

SUMMARY OF THE INVENTION

The invention provides photographic element comprising a light-sensitive silver halide emulsion layer having associated therewith a magenta dye forming coupler and a light-sensitive silver halide emulsion layer having associated therewith a yellow dye-forming coupler, wherein the magenta and yellow dye forming couplers are represented by formula M and Y respectively:

M

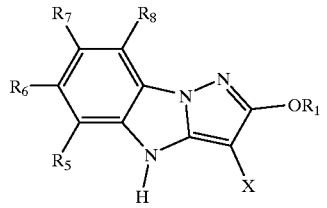

Y

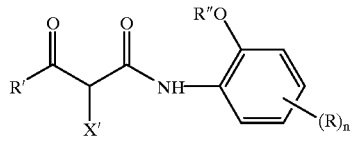

wherein:

$R_1$, R' and R" are independently selected alkyl or aryl groups;

$R_5$–$R_8$ and each R are independently H or a substituent group;

n is 0–4; and

X and X' are H or a coupling-off group.

The invention provides a combination of magenta and yellow dye forming couplers that together exhibit improved dye fade resistance and an equal or increased red color gamut.

DETAILED DESCRIPTION OF THE INVENTION

As indicated, the invention provides a photographic element comprising a light-sensitive silver halide emulsion layer having associated therewith a magenta dye forming coupler and a light-sensitive silver halide emulsion layer having associated therewith a yellow dye-forming coupler, wherein the magenta and yellow dye forming couplers are represented by formula M and Y respectively:

M

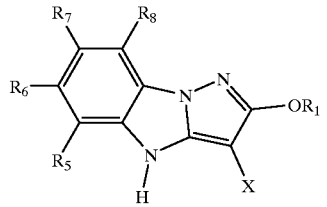

Y

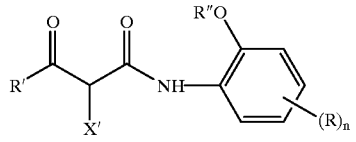

wherein:

$R_1$, R' and R" are independently selected alkyl or aryl groups;

$R_5$–$R_8$ and each R are independently H or a substituent group;

n is 0–4; and

X and X' are H or a coupling-off group.

$R_1$ is suitably is suitably an alkyl group and desirably a branched preferably alpha branched alkyl group such as cyclohexyl, 1-methyldecyl, decahydronaphthalene, etc. R' is suitably a branched alkyl group such as t-butyl, t-pentyl, t-octyl, methylcyclopropyl, and adamantyl. R" is suitably a secondary or tertiary alkyl group such as isopropyl, sec-butyl, cyclohexyl, or 1-methyl decyl.

$R_5$–$R_8$ are suitably any substituent such as H, alkyl, alkoxy or aryloxy groups. Typically they are all H unless a substituent is needed to provide ballast.

Each X and X' is H or a coupling-off group. Generally these are heterogroups linked to the rest of the molecule by a heteroatom. Suitable X is linked through a sulfur atom and is, for example, a thioglycerol or mercaptopropionic acid. X' is conveniently an aryloxy or N-linked N-heterocycle such as an azole compound including -dione moieties and azole groups containing 1–3 carbon atoms.

R is desirably contains a ballast group and is typically located in the 5-position.

Suitable examples of the magenta and yellow couplers are as follows

M1

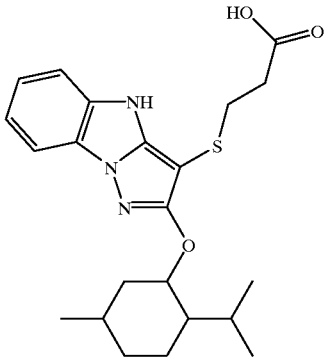

M2

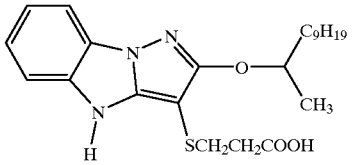

M3

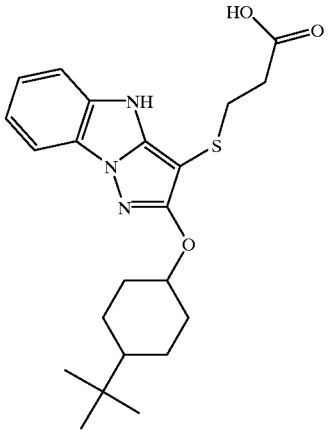

-continued

M4

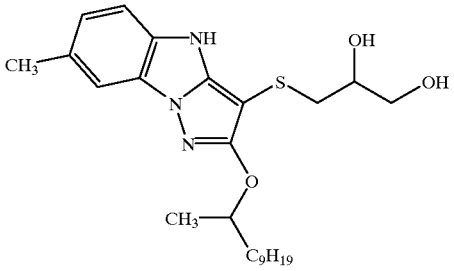

M5

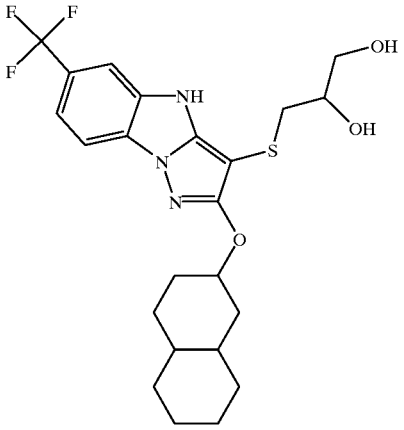

M6

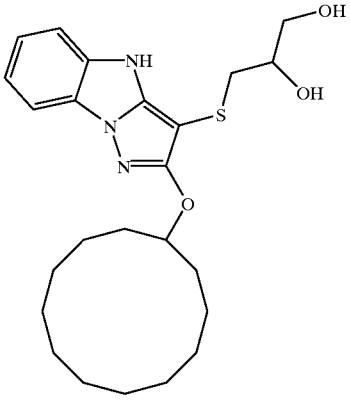

M7

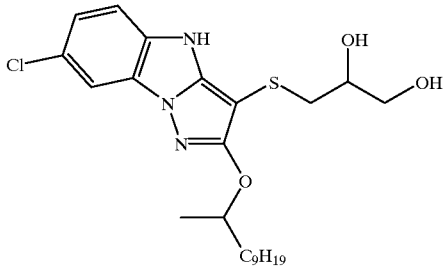

-continued
M8
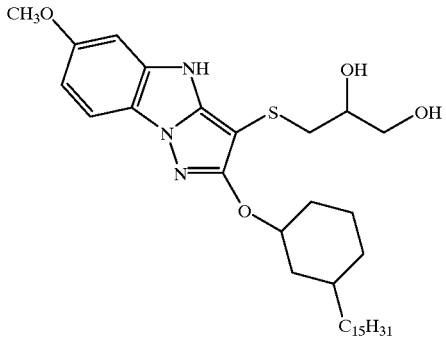
M9
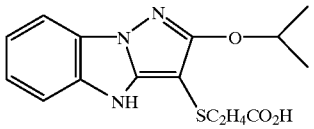
Y1
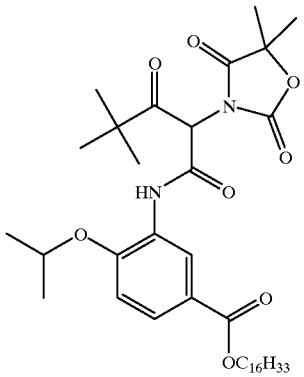
Y2
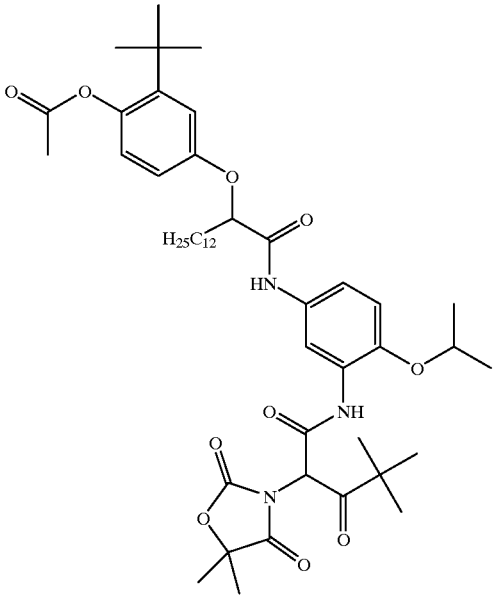
-continued
Y3
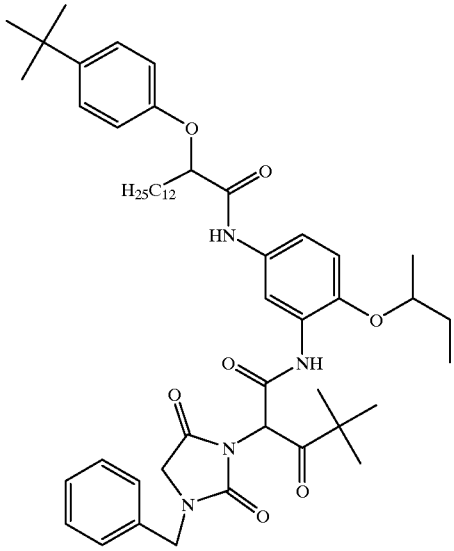
Y4
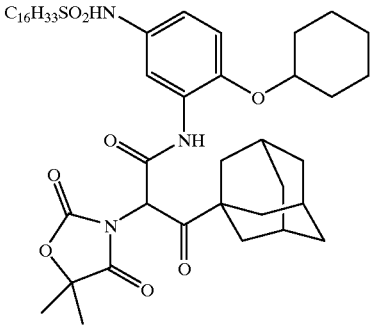
Y5
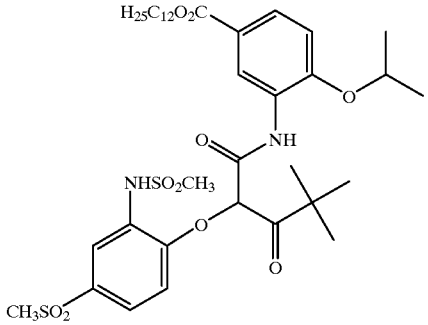
Y6
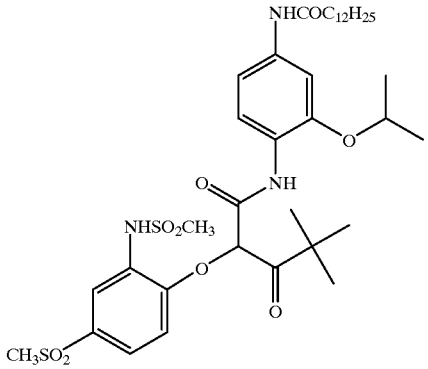

-continued

Y7

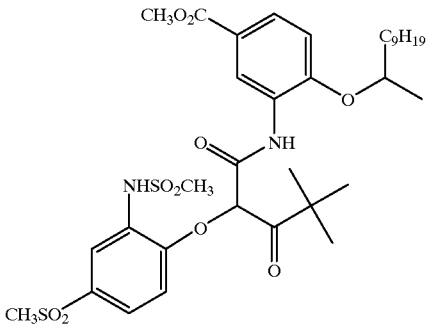

Dye stabilizers useful with the magenta coupler may be represented by formula (2):

(2)

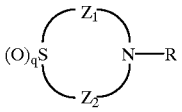

wherein $Z_1$ and $Z_2$ are alkylene groups of 1–3 carbon atoms;

R is an aryl or heterocyclic group, and q is 1 or 2.

In a particular embodiment of the invention, the stabilizer is more specifically represented by Formula (3a).

(3a)

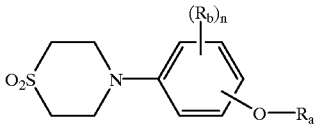

In Formula (3a)

$R_a$ is an alkyl group;

$R_b$ is an alkyl group, an alkoxy group, a primary or secondary amino group, or an amido group;

n is an integer from 0 to 4.

The following examples further illustrate this stabilizer.

ST-1

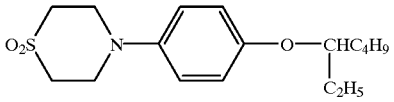

ST-2

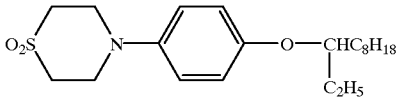

ST-3

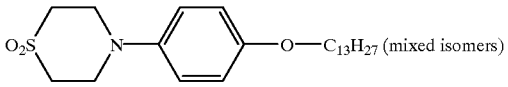

-continued

ST-4

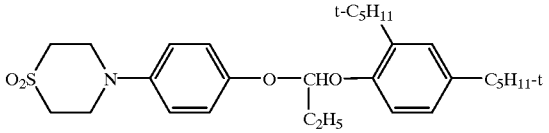

ST-5

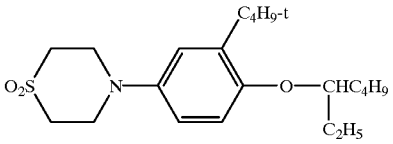

ST-6

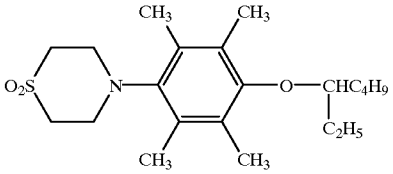

ST-7

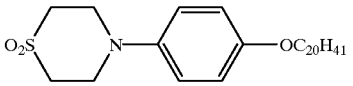

ST-8

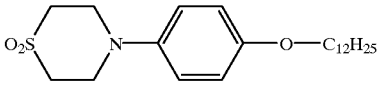

ST-9

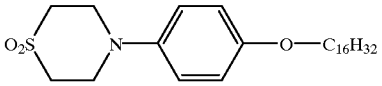

ST-10

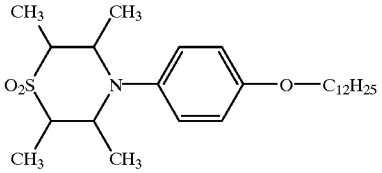

ST-11

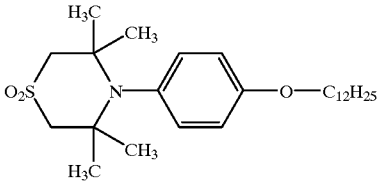

ST-12

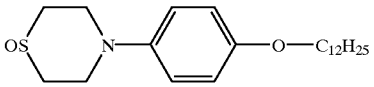

ST-13

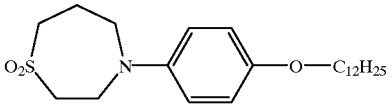

-continued

ST-14

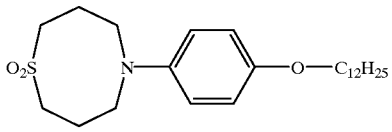

ST-15

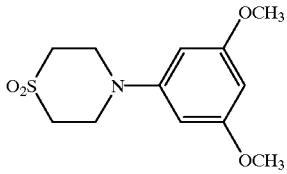

ST-16

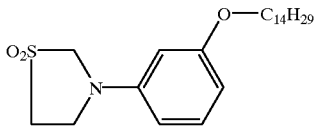

These stabilizers may be prepared as described in U.S. Pat. No. 4,880,733.

It is often desirable to include one or more additional stabilizers. One type is represented by formula (4):

(4)

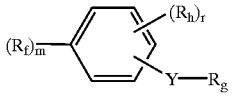

wherein:

each $R_f$ is an independently selected alkyl or alkoxy group having 1–32 carbon atoms and m is 1–4;

each $R_h$ is an independently selected substituent and r is 0–4;

Y is —$NHSO_2$— or —$SO_2NH$—; and $R_g$ is an alkyl group of 1–16 carbon atoms.

Examples are:

4-1

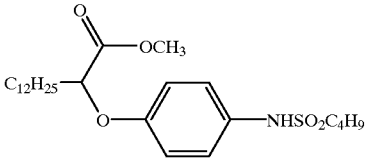

4-2

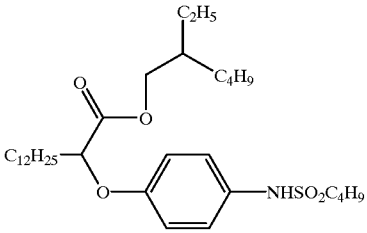

-continued 4-3

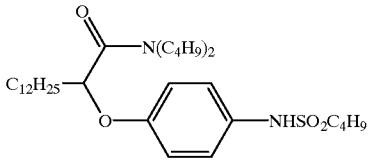

4-4

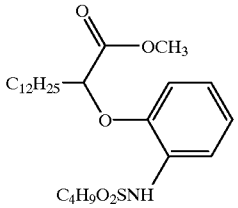

4-5

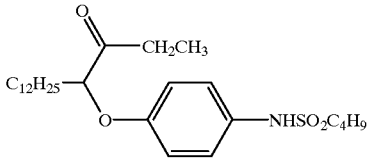

4-6

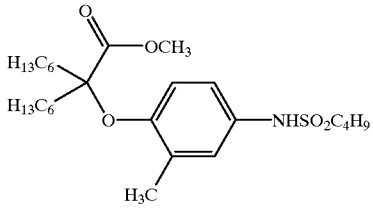

4-7

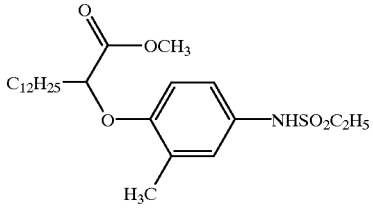

4-8

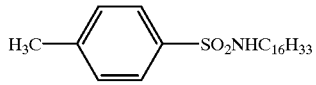

4-9

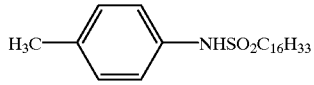

Another secondary stabilizer that may be employed is represented by Formula (5):

(5)

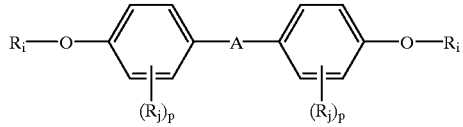

wherein:

each $R_i$ independently represents a hydrogen atom, an alkyl group, an alkenyl group or an aryl group;

each $R_j$ independently represents a halogen atom, an alkyl group, an alkenyl group an alkoxy group, an aryl group, an aryloxy group, an alkylthio group, an aryl thio group, an acyl group, an acylamino group, a sulfonyl group, a sulfonamide group or a hydroxy group;

each p is, individually an integer of 0 to 4; and

A represents an alkylene group having 1 to 6 carbon atoms in its linear structure.

The stabilizers that have the Formula (5), above, are believed to stabilize the dye image by scavenging free radicals. In this formula, the group represented by A is a straight, branched, or cyclic alkylene group, the linear portion of which has 1 to 6 carbon atoms, which includes those such groups substituted with one or more aryl, cyano, halogen, heterocyclyl, cycloalkyl, alkoxy, hydroxy, and aryloxy groups. The alkylene group can form a cycloalkyl ring, such as

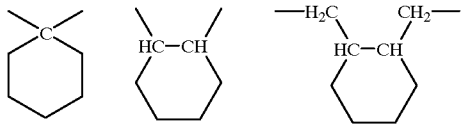

In Formula (5), each $R_j$ can be a substituent group such as halogen, alkyl, cycloalkyl, alkenyl, alkoxy, aryl, aryloxy, alkylthio, arylthio, acyl, acylamino, sulfonyl and sulfonamido groups.

Preferred compounds represented by Formula (5), are those in which:

each $R_i$ is independently hydrogen or a (cyclo)alkyl group of 1 to 8 carbon atoms;

each $R_j$ is independently hydrogen, hydroxy, alkyl or alkoxy group of 1 to 8 carbon atoms;

each p is independently an integer of 0 to 2; and

A is an alkylene group of 1 to 10 carbon atoms.

Representative examples of stabilizer compounds which satisfy Formula (5) are:

5-1

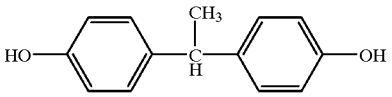

5-2

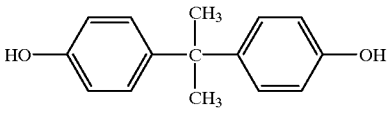

5-3

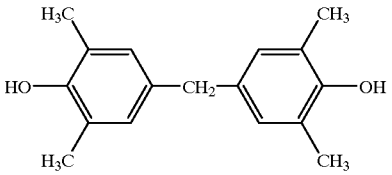

5-4

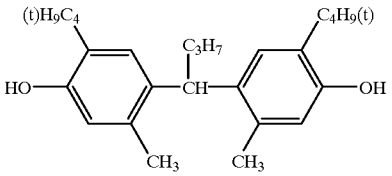

-continued 5-5

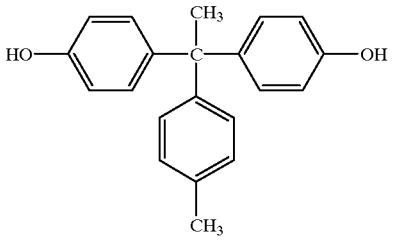

5-6

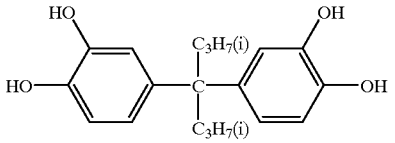

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido;

sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp.126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192–350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0415 375; EPO 0437 818; EPO 0447 969; EPO 0 542 463; EPO 0 568 037; EPO 0 568 196; EPO 0 568 777; EPO 0 570006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58–113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

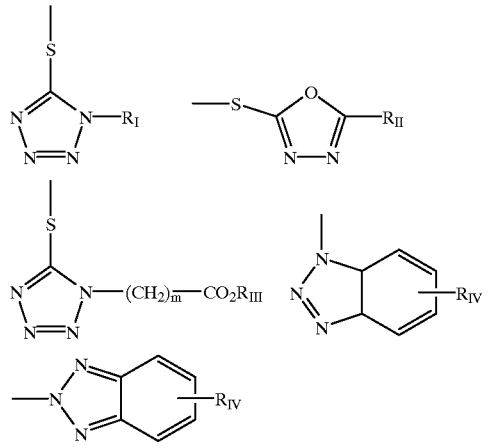

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

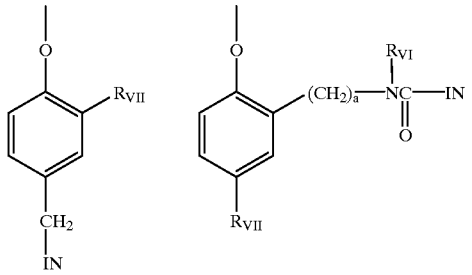

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60–249149.

Suitable developer inhibitor-releasing couplers for use in the present invention include, but are not limited to, the following:

D1

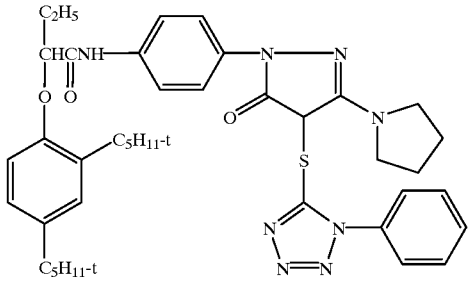

D2

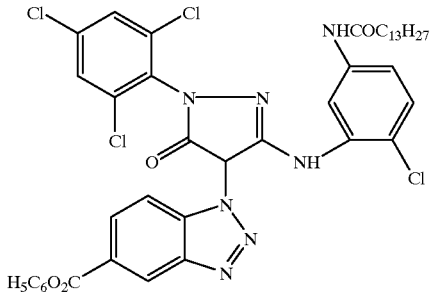

D3

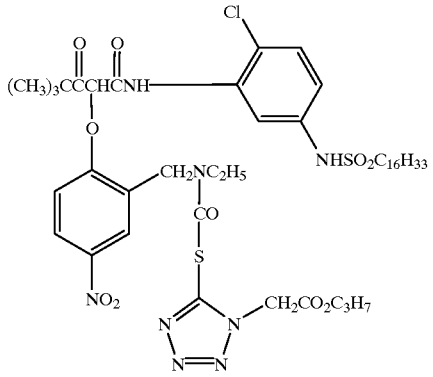

D4

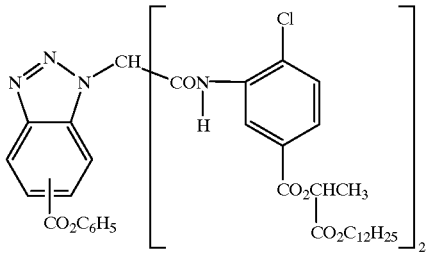

-continued
D5
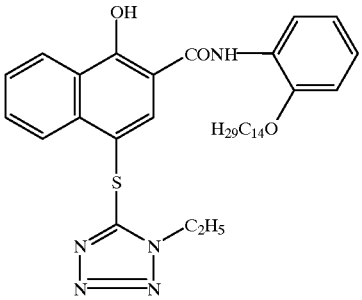
D6
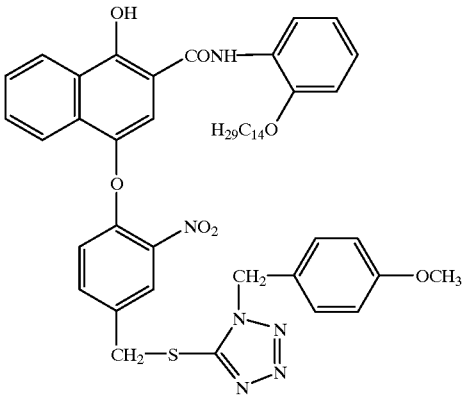
D7
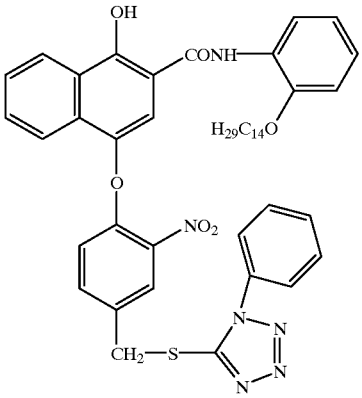
D8
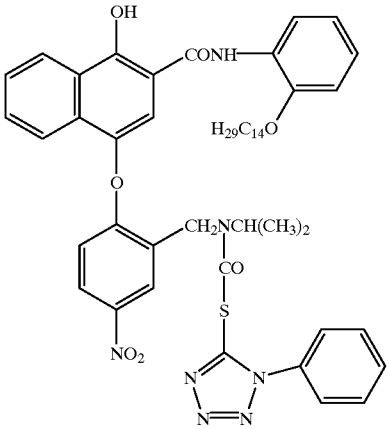
-continued
D9
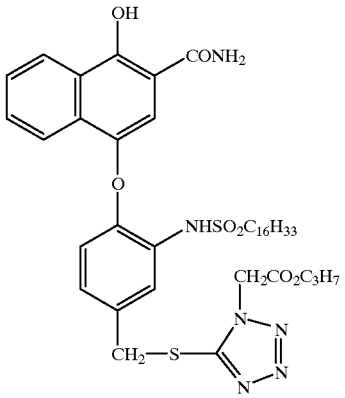
D10
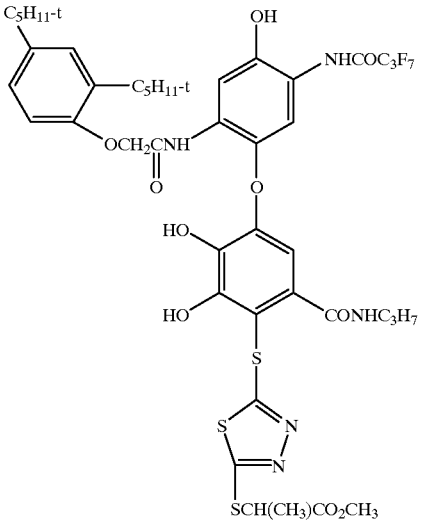
D11
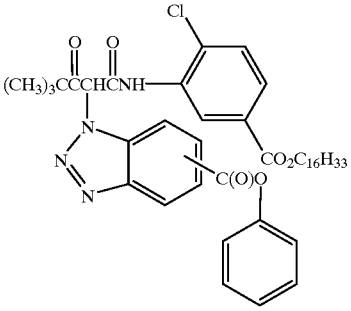
D12
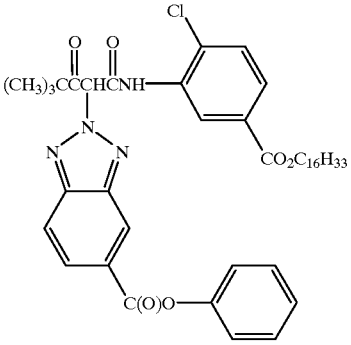

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al U.S. Pat. No. 5,219, 720 and 5,334,495, Delton U.S. Pat. Nos. 5,310,644, 5,372, 927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

COUPLER SYNTHESIS

Preparation of Magenta Coupler M9

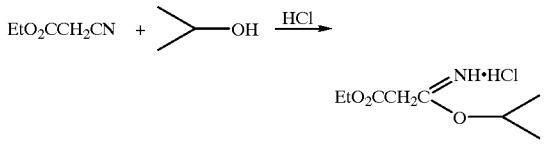

Ethyl cyanoacetate (11.3 g)(0.1 m) and isopropanol (6.0 g)(0.1 m) were dissolved in anhydrous ether (ca 16 ml ). HCl gas was passed through the solution at 0–10 degrees for 1.5 hours, until saturated. The flask was stoppered and stood in the refrigerator over the weekend. The solvent was then removed under vacuum at room temperature leaving an oil. Toluene (ca 50–100 ml) was added and decanted from the oil. Ligroin (ca 100 ml) was added and stripped off on the rotary evaporator at RT or below, giving a white solid. The solid was worked up with more ligroin, filtered and dried. The yield was 18 g (85.9%).

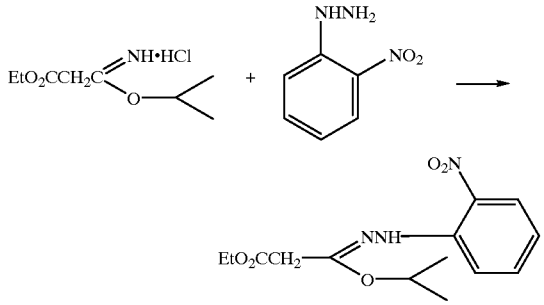

2-Nitrophenylhydrazine (1.53 g)(0.01 m) was dissolved in t-butanol (25 ml ). The imidate shown (2.1 g)(0.01 m) was added to the mixture. Solution was stirred for about an hour, until starting material has disappeared. Product is a mixture by TLC. Ethyl acetate (200 ml) was added, and the solution washed with water containing a little NaCl, 2 times to remove ammonium chloride. The ethyl acetate layer was dried over magnesium sulfate and evaporated to dryness, giving a red oil.

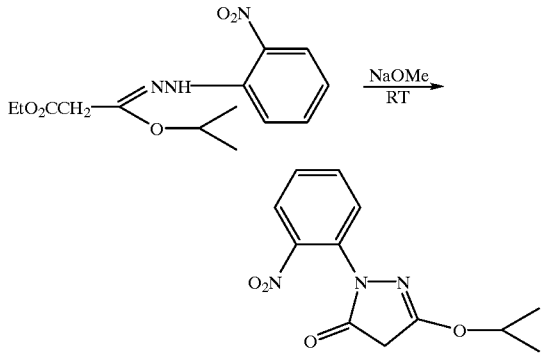

Sodium (0.46 g)(0.02 m) was dissolved in 25 ml anhydrous methanol. The sodium methoxide solution was added to the red oil from above. (The reaction mixture was checked by TLV by spotting into water and acidifying with dilute acetic acid prior to extraction into EtAc). The reaction should form a single spot essentially. May need to leave overnight. The reaction was added dropwise into 150 ml of 10% acetic acid in water into which was dissolved a little NaCl. The product was filtered and washed with water. The yield was 1.77 g. The solid was recrystallized from hot heptane (200–250 ml). (decanted from black oily residue). The yield was 1.4 g (53%).

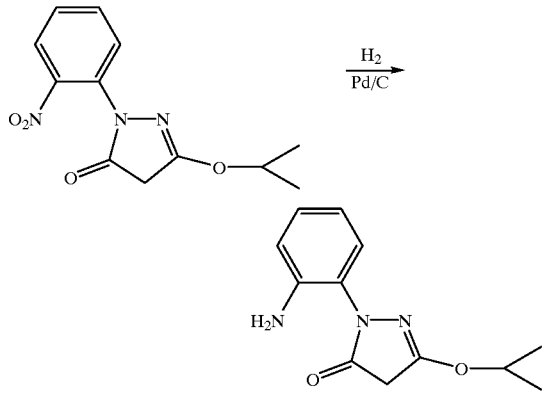

Reduction was carried out in THF with Pd/C at RT and 200–300 psi hydrogen. The yield after evaporation of solvent was 5.67 g (99.1%).

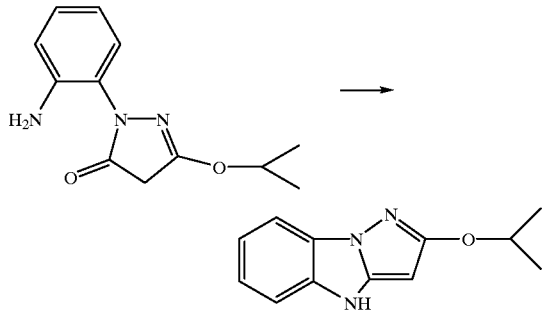

The amine, isolated from reduction, (14 g)(0.06 m) was dissolved in DMF(210 ml), and p-toluene sulfonic acid (1.4 g) was added. The mixture was heated on a steam bath for 5 hours, then left overnight at room temperature. It was heated for a further 4 hours until TLC indicated starting material had disappeared. The solution was added dropwise to water (2000 ml). An orange solid precipitated. It was filtered, washed with water and dried. The yield was 11.03 g. The solid was recrystallized from toluene (200 ml ) giving 8.13 g. A second crop yielded a further 1.08 g. Total yield was 71.3%.

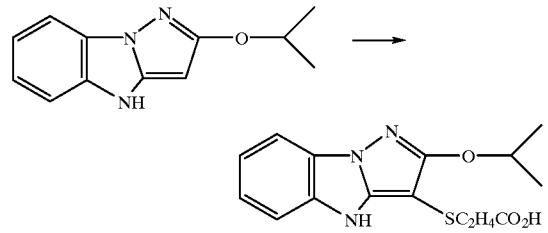

2-Isopropoxypyrazolo[5,1-a]benzimidazole (6.45 g)(0.03 m) and mercaptopropionic acid (4.14 g)(0.39 m) were dissolved in DMF (156 ml). Bromine (7.02 g)(0.039 m) was added in 15 mls of DMF, dropwise at RT. The mixture was stirred at RT until complete (overnight) and then added dropwise to water (1200 mls) with stirring. Initially it was sticky but slowly went solid. The product was filtered to give a brownish solid. Crude yield was 7.5 g (78.3%). Product was crystallized from toluene (75 mls), giving 6.7 grams (70%).

Yellow Coupler Preparation

The following preparation of the coupler Y1 (or C2) is illustrative for all the couplers of this invention. All the compounds prepared had infra-red, mass and NMR spectra which were in accord with sufficiently pure samples of the desired products.

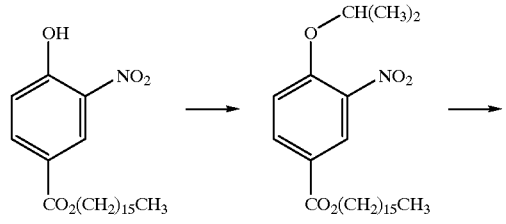

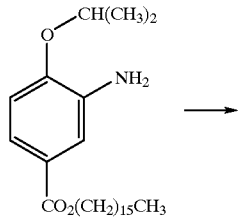

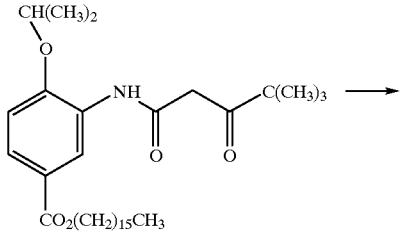

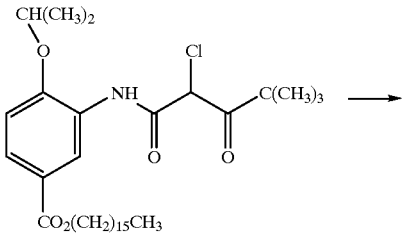

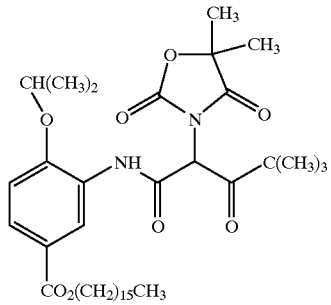

Compound (2) The ester (1) (39.3 g, 0.097 mol), anhydrous potassium carbonate (50 g, 0.362 mol) and isopropyl bromide (13.53 g, 0.11 mol) were added to a three-necked flask fitted with a magnetic stirrer. Dimethylformamide (300 ml) was added and the mixture stirred and heated to 110° C. (oil bath temperature) for 3 h. Further portions of isopropyl bromide (total of 8.0 g) were added to the reaction mixture over the course of the following 4h. The mixture was allowed to cool and poured into water (31) with stirring. The pale yellow precipitate was filtered, washed with water and dried under vacuum at 40° C. Yield: 37.7 g (87%).

Compound (3) The nitro compound (2) (50 g, 0.11 mol) was dissolved in tetrahydrofuran (500 ml) and 5% palladium on carbon catalyst (0.3 g) was added. The mixture was hydrogenated at room temperature overnight under 34 atmospheres pressure of hydrogen. The catalyst was filtered off and the solvent removed under reduced pressure. The product was obtained as an oil which gradually solidified. Yield: 40.6 g (89%).

Compound (4) Amine (3) (40.6 g, 0.097 mol) and methyl pivaloylacetate (17.4 g, 0.11 mol) were dissolved in heptane (11) and heated to reflux for 2 h in a Soxhlet apparatus containing 4A molecular sieve. A further quantity of methyl pivaloylacetate (2.0 g) was added and the mixture heated for a further 5 h. The reaction was allowed to stand overnight. The product was obtained as white crystals which were filtered, washed with heptane and dried under vacuum. Yield: 48.3 g (91%).

Compound (5) Coupler (4) (40.0 g, 0.073 mol) was dissolved in dichloromethane (600 ml). Sulfuryl chloride (9.9 g, 0.0733 mol) in dichloromethane (50 ml) was added dropwise to the coupler solution with stirring. The mixture was allowed to stand overnight. The solvent was removed under reduced pressure and the residual oil solidified to a white powder. Yield: 42.5 g (quantitative).

Coupler (Y1 or C2) Coupler (5) (42.5 g, 0.0732 mol), dimethyl oxazolidinedione (9.7 g, 0.075 mol) and triethylamine (7.6 g, 0.075 mol) were dissolved in acetonitrile (750 ml) and heated to reflux. After 1 h, further dimethyl oxazolidinedione (2.0 g) was added. The mixture was heated for a further 3 h. The volume of the solution was reduced (to around 150 ml) under reduced pressure and the mixture poured onto ice/-hydrochloric acid (21 ice/10 ml conc. hydrochloric acid). The product was filtered, dried under vacuum and recrystallized twice from heptane. The coupler (Y1) was obtained as pure white crystals. Yield: 38.0 g (77%).

| | | | | |
|---|---|---|---|---|
| $C_{38}H_{60}N_2O_8$ | Requires: | C; 67.82 | H; 8.99 | N; 4.16 |
| | Found: | C; 67.42 | H; 8.82 | N; 4.08 |

Preparation of Photographic Elements

Photographic elements containing magenta couplers were prepared as follows:

Dispersions of the couplers were prepared as below. In one vessel, the coupler, coupler solvent, stabilizer(s), and ethyl acetate were combined and warmed to dissolve. To this solution was added gelatin, surfactant, and water. After manual mixing the mixture was passed three times through a Gaulin colloid mill.

The photographic elements were prepared by coating the following layers in the order listed on a resin-coated paper support:

| | |
|---|---|
| 1st layer | |
| Gelatin | 3.23 g/m$^2$ |
| 2nd layer | |
| Gelatin | 1.83 g/m$^2$ |
| Coupler | 0.53 mmol/m$^2$ |
| Dibutylphthalate | 0.54 g/m$^2$ |
| Stabilizer A | 0.27 g/m$^2$ |
| Stabilizer B | 0.27 g/m$^2$ |
| Green sensitized AgCl emulsion | 0.17 g/m$^2$ |
| 3rd layer | |
| Gelatin | 1.34 g/m$^2$ |
| 2-(2H-benzotriazol-2-yl)-4,6-bis-(1,1-dimethylpropyl)phenol | 0.73 g/m$^2$ |
| Tinuvin 326 ™ (Ciba-Geigy) | 0.13 g/m$^2$ |
| Hexanoic acid,2-ethyl-,1,4-cyclohexanediyl bis(methylene)ester | 0.29 g/m$^2$ |
| 1,4-Benzenediol,2,5-bis(1,1,3,3-tetramethylbutyl)- | 0.18 g/m$^2$ |
| 4th layer | |
| Gelatin | 1.40 g/m$^2$ |
| Bis(vinylsulfonylmethyl)ether | 0.14 g/m$^2$ |

Stabilizer A

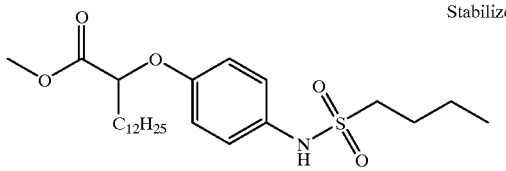

Stabilizer B

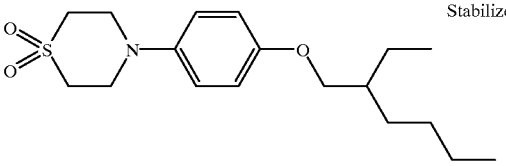

The photographic elements of the examples containing the yellow couplers were prepared as follows:

On a gel-subbed, polyethylene-coated paper support were coated the following layers:

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of blue-sensitized silver chloride emulsion containing 0.28 grams silver; a dispersion containing ($8.80\times10^{-4}$ mole) of coupler, and 0.043 gram surfactant Alkanol XC (trademark of E. I. Dupont Co.) (in addition to the Alkanol XC used to prepare the coupler dispersion). The coupler dispersion contained the coupler, all of the gelatin in the layer except that supplied by the emulsion, an amount of dibutyl phthalate equal to 46.5% of the weight of coupler, an amount of 2-[2-(butoxyethoxy) ethyl acetate equal to 38.7% of the weight of coupler, and 0.22 gram Alkanol XC.

Third Layer

A protective layer containing (per square meter) 1.40 grams gelatin, 0.15 gram bis(vinylsulfonyl)methyl ether, 0.043 gram Alkanol XC, and $4.40\times10^{-6}$ gram tetraethylammonium perfluorooctanesulfonate.

Samples were prepared containing the magenta or yellow couplers and tested for dye fade. The samples were as follows:

TABLE 1

| Sample Description | | | |
|---|---|---|---|
| Sample | Magenta Coupler | Yellow Coupler | Inv. or Comp. |
| 1 | M1 | Y1 | Inv. |
| 2 | M2 | Y1 | Inv. |
| 3 | M3 | Y1 | Inv. |
| 4 | CM1 | Y1 | Comp. |
| 5 | CM2 | Y1 | Comp. |
| 6 | M1 | CY | Comp. |
| 7 | M2 | CY | Comp. |
| 8 | M3 | CY | Comp. |
| 9 | CM1 | CY | Comp. |
| 10 | CM2 | CY | Comp. |

Preparation of Processed Photographic Examples

Processed samples were prepared by exposing the coatings through a step wedge and processing as follows:

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7° C. | |

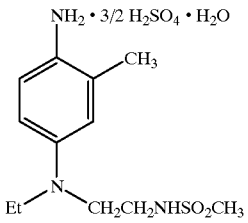

Dev-1

The density of each step of each strip was measured. The strips were then covered by UV-absorbing filters (in lieu of coating a similar filter layer over the photosensitive layer of the photographic element) and subjected to irradiation by the light of a xenon arc lamp at an intensity of 50K lux for a total of 3 weeks with the densities being measured periodically during the test as indicated in Table 2. The fade of the magenta specimen from a density of 1.0 was determined and the same was done for the yellow specimen. The two values were then combined to determine the overall fade of the two couplers. (maximum of —2.0 possible). The light stability of the dyes, expressed as the density remaining from an initial combined density of 2.0, is shown in Table 2.

The absorption spectra calculated for multilayer samples using a conventional cyan dye forming coupler at a series of increasing densities between Dmin and Dmax was obtained between the wavelength ranges of 400 nm to 800 nm using a commercially available visible spectrophotometer. Next, the unique characteristic spectra of each dye was determined using a computerized regression algorithm which reduces the absorption spectrum of each dye as a function of density to a single spectra of the dye which is independent of density. This spectrum, known as the characteristic vector of the dye used to calculate the spectral distribution of the dye at any wavelength and was used in subsequent color modeling determinations.

Using the characteristic absorption spectra above, the red dye gamut was determined by varying the magenta and yellow dyes and determining the resultant values of a*, b*, L* and C* using the equations standardized by CIELAB. The red color gamut was determined and the results were recorded in Table 2.

TABLE 2

| Sample | Inv. or Comp. | Light Fade from 2.0 | Red Color Gamut |
|---|---|---|---|
| 1 | Inv. | −0.55 | 5885 |
| 2 | Inv. | −0.57 | 5785 |
| 3 | Inv. | −0.56 | 5776 |
| 4 | Comp. | −0.67 | 5631 |
| 5 | Comp. | −0.81 | 5113 |
| 6 | Comp. | −0.92 | 5849 |
| 7 | Comp. | −0.94 | 5751 |
| 8 | Comp. | −0.93 | 5743 |
| 9 | Comp. | −1.04 | 5648 |
| 10 | Comp. | −1.18 | 5214 |

As the data shows, the light fade of the dye formed by the element of the invention was in the range of 0.55 to 0.57 while for the comparisons it was from 0.67 to 1.18 giving a an improvement ranging from 15–52%. At the same time, the gamut or range of red color that can be reproduced was equal or up to 15% better than the comparisons.

The comparison couplers were as follows:

CM1

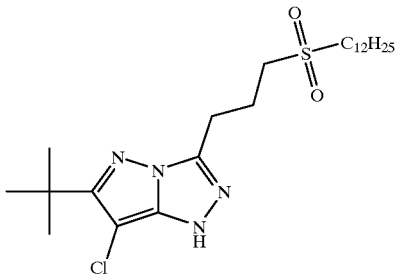

CM2

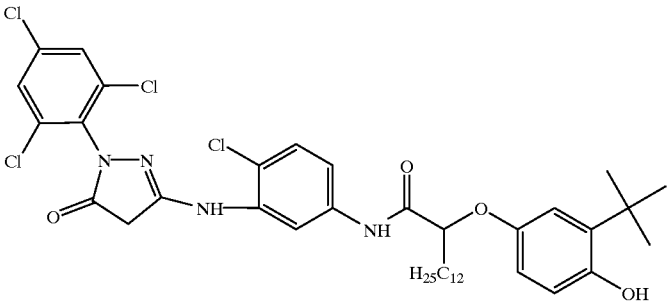

CY

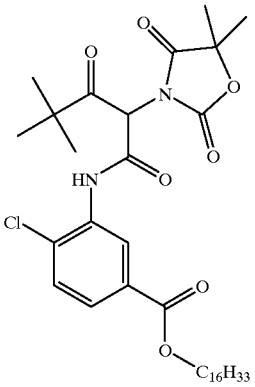

The entire contents of the patents and other publications referred to in this specification are incorporated herein by reference.

What is claimed is:

1. A photographic element comprising a light-sensitive silver halide emulsion layer having associated therewith a magenta dye forming coupler and a light-sensitive silver halide emulsion layer having associated therewith a yellow dye-forming coupler, wherein the magenta and yellow dye forming couplers are represented by formula M and Y respectively:

M

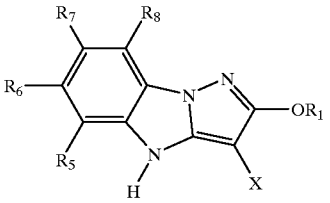

-continued

Y

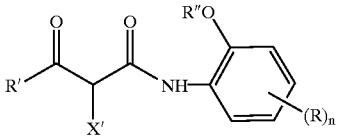

wherein:

$R_1$, R' and R" are independently selected alkyl or aryl groups;

$R_5$–$R_8$ and each R are independently H or a substituent group;

n is 0–4; and

X and X' are H or a coupling-off group.

2. The element of claim 1 wherein $R_1$ is an alkyl group.

3. The element of claim 2 wherein $R_1$ is an alpha substituted alkyl group.

4. The element of claim 3 wherein $R_5$–$R_8$ are H.

5. The element of claim 1 wherein R" is an alkyl group.

6. The element of claim 1 wherein R' is an alpha branched alkyl group.

7. The element of claim 6 wherein R' is a t-butyl group, an adamantyl group, or a methylcyclopropyl group.

8. The element of claim 1 wherein X is a thioglycerol or a mercaptopropionic acid group.

9. The element of claim 1 wherein R' is an alpha branched alkyl group.

10. The element of claim 1 wherein R is selected from the group consisting of —$NHCOR_a$, —$CONHR_a$, —$SO_2NHR_a$, —$NHSO_2R_a$, —$COOR_a$, —$OCONHR_a$, wherein each $R_a$ is a substituent such that the combined groups Ra contain at least 8 carbon atoms.

11. The element of claim 1 in which R is a substituent group located in the 5-position.

* * * * *